US011663987B2

(12) United States Patent
Lin et al.

(10) Patent No.: US 11,663,987 B2
(45) Date of Patent: May 30, 2023

(54) DISPLAY APPARATUS AND DRIVING METHOD THEREOF

(71) Applicant: E Ink Holdings Inc., Hsinchu (TW)

(72) Inventors: Yi-Sheng Lin, Hsinchu (TW); Chen Chu Tsai, Hsinchu (TW); Chia-Chun Yeh, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/412,271

(22) Filed: Aug. 26, 2021

(65) Prior Publication Data

US 2022/0148526 A1 May 12, 2022

(30) Foreign Application Priority Data

Nov. 11, 2020 (TW) ..... 109139252

(51) Int. Cl.
*G09G 3/34* (2006.01)
*G09G 3/00* (2006.01)

(52) U.S. Cl.
CPC ..... *G09G 3/344* (2013.01); *G09G 3/035* (2020.08); *G09G 2310/027* (2013.01); *G09G 2380/02* (2013.01)

(58) Field of Classification Search
None
See application file for complete search history.

(56) References Cited

U.S. PATENT DOCUMENTS 8,044,927 B2 10/2011 Inoue
9,541,494 B2 * 1/2017 Baker ..... G01N 21/25
10,074,300 B2 9/2018 Yeon et al.
2008/0186324 A1 * 8/2008 Chiang ..... G09G 3/3611 345/589
2010/0085284 A1 * 4/2010 Lee ..... G09G 3/344 345/77
2012/0019509 A1 * 1/2012 Wei ..... G09G 3/344 345/107
2012/0293480 A1 11/2012 Lin et al.
2013/0100103 A1 * 4/2013 Lai ..... G09G 3/344 345/211
2016/0125812 A1 * 5/2016 Liu ..... G09G 3/344 345/690
2020/0035204 A1 * 1/2020 Wu ..... G09G 5/14
2022/0050652 A1 * 2/2022 Heo ..... G09G 3/3406

FOREIGN PATENT DOCUMENTS

CN 106486044 3/2017
TW I497482 8/2015
TW 201621877 6/2016

* cited by examiner

*Primary Examiner* — Matthew Yeung
(74) *Attorney, Agent, or Firm* — JCIPRNET

(57) ABSTRACT

A display apparatus including a display panel and a display driver is provided. The display driver is coupled to the display panel. The display driver is configured to drive the display panel by at least one of a plurality of gray levels to display an image frame in a first state. The display driver is configured to drive the display panel by a predetermined gray level to display a standby frame in a second state. The display driver determines the predetermined gray level of the standby frame according to the gray levels of the image frame. In addition, a driving method of a display apparatus is also provided.

9 Claims, 3 Drawing Sheets

DISPLAY APPARATUS AND DRIVING METHOD THEREOF

CROSS-REFERENCE TO RELATED APPLICATION

This application claims the priority benefit of Taiwan application serial no. 109139252, filed on Nov. 11, 2020. The entirety of the above-mentioned patent application is hereby incorporated by reference herein and made a part of this specification.

BACKGROUND

Technical Field

The disclosure relates to an electronic device and a driving method thereof, and more particularly, to a display apparatus and a driving method thereof.

Description of Related Art

In recent years, with the advantages of lightness/thinness, durability, and low power consumption which is in line with energy saving and environmental protection, the electronic paper display apparatus has been widely applied to e-readers (e.g., e-books, electronic newspapers) or other electronic components (e.g., electronic tags) on the market. However, taking the flexible electronic paper display apparatus as an example, after the flexible electronic paper display apparatus is folded or rolled for a long time or multiple times, the performance of its display panel may decrease due to the mechanical fatigue effect. Therefore, when the performance of the display panel decreases due to the mechanical fatigue effect, the difference in the gray level or color of the pixel as compared with the surrounding region may increase. The user may perceive this difference in the normal display state and perceive the disuniformity (mura) of the image frame, which thus undermines the user experience.

SUMMARY

The disclosure provides a display apparatus and a driving method thereof, in which the displayed image frame is uniform and a good user experience can be provided.

A display apparatus of the disclosure includes a display panel and a display driver. The display driver is coupled to the display panel. The display driver is configured to, in a first state, drive the display panel by at least one of a plurality of gray levels to display an image frame. The display driver is configured to, in a second state, drive the display panel by a predetermined gray level to display a standby frame. The display driver determines the predetermined gray level of the standby frame according to the gray levels of the image frame.

In an embodiment of the disclosure, the gray levels include a first gray level and a second gray level, and an arithmetic mean of the first gray level and the second gray level is a median of the gray levels. The predetermined gray level is selected from the first gray level or the second gray level.

In an embodiment of the disclosure, the gray levels include a first gray level and a second gray level, and an arithmetic mean of the first gray level and the second gray level is a median of the gray levels. The gray levels further include a lowest gray level. In the first state, the display driver drives the display panel by the lowest gray level to display a background part of the image frame. The first gray level and the second gray level are greater than the lowest gray level. The predetermined gray level is greater than or equal to the lowest gray level, and the predetermined gray level is less than the first gray level or the second gray level.

In an embodiment of the disclosure, the gray levels include a first gray level and a second gray level, and an arithmetic mean of the first gray level and the second gray level is a median of the gray levels. The gray levels further include a highest gray level. In the first state, the display driver drives the display panel by the highest gray level to display a background part of the image frame. The first gray level and the second gray level are less than the highest gray level. The predetermined gray level is less than or equal to the highest gray level, and the predetermined gray level is greater than the first gray level or the second gray level.

In an embodiment of the disclosure, the display driver is further configured to calculate a gray level average of each pixel on the display panel, and determine the predetermined gray level according to the gray level average of each pixel.

In an embodiment of the disclosure, the standby frame includes a dot pattern. The dot pattern includes a plurality of pixel blocks. Each of the pixel blocks includes at least one pixel. The display driver drives a part of the pixel blocks by the predetermined gray level to display the standby frame. The pixel blocks driven by the predetermined gray level are not adjacent to each other in a horizontal direction and a vertical direction.

A driving method of a display apparatus of the disclosure includes the following steps. In a first state, a display panel is driven by at least one of a plurality of gray levels to display an image frame. A predetermined gray level is determined according to the gray levels of the image frame. In a second state, the display panel is driven by the predetermined gray level to display a standby frame.

In an embodiment of the disclosure, the gray levels include a first gray level and a second gray level, and an arithmetic mean of the first gray level and the second gray level is a median of the gray levels. The predetermined gray level is selected from the first gray level or the second gray level.

In an embodiment of the disclosure, the driving method of the display apparatus further includes the following step. In the first state, the display panel is driven by a lowest gray level to display a background part of the image frame. The gray levels include a first gray level, a second gray level, and the lowest gray level. The first gray level and the second gray level are greater than the lowest gray level. An arithmetic mean of the first gray level and the second gray level is a median of the gray levels. The predetermined gray level is greater than or equal to the lowest gray level, and the predetermined gray level is less than the first gray level or the second gray level.

In an embodiment of the disclosure, the driving method of the display apparatus further includes the following step. In the first state, the display panel is driven by a highest gray level to display a background part of the image frame. The gray levels include a first gray level, a second gray level, and the highest gray level. The first gray level and the second gray level are less than the highest gray level. An arithmetic mean of the first gray level and the second gray level is a median of the gray levels. The predetermined gray level is less than or equal to the highest gray level, and the predetermined gray level is greater than the first gray level or the second gray level.

In an embodiment of the disclosure, the standby frame includes a dot pattern. The dot pattern includes a plurality of pixel blocks. Each of the pixel blocks includes at least one pixel. The step of driving the display panel by the predetermined gray level to display the standby frame in the second state includes the following step. A part of the pixel blocks is driven by the predetermined gray level to display the standby frame. The pixel blocks driven by the predetermined gray level are not adjacent to each other in a horizontal direction and a vertical direction.

Based on the above, in the embodiments of the disclosure, the display driver drives the display panel by the predetermined gray level to display the standby frame in the second state, which can prevent the user from perceiving the disuniformity of the image frame in the first state.

To make the aforementioned more comprehensible, several embodiments accompanied with drawings are described in detail as follows.

DESCRIPTION OF THE EMBODIMENTS

In the following, as an example of the display apparatus, a flexible electronic paper display apparatus will be described with reference to the accompanying drawings. However, the display apparatus of the disclosure is not limited to the flexible electronic paper display apparatus.

Figure 1:
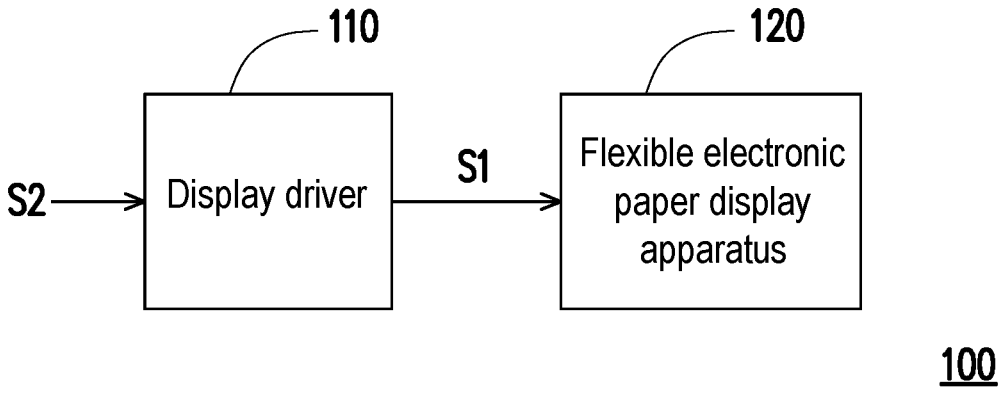
FIG. 1 is a schematic view of a flexible electronic paper display apparatus according to an embodiment of the disclosure.

FIG. 1 is a schematic view of a flexible electronic paper display apparatus according to an embodiment of the disclosure. Referring to FIG. 1, a flexible electronic paper display apparatus 100 of this embodiment includes a display driver 110 and a flexible electronic paper display panel 120. The display driver 110 is coupled to the flexible electronic paper display panel 120. The display driver 110 outputs a driving signal S1 to drive the flexible electronic paper display panel 120 to display an image frame. The flexible electronic paper display apparatus 100 may be a color electronic paper display apparatus or a black-and-white electronic paper display apparatus, which is not specifically limited herein. Therefore, the image frame displayed by the flexible electronic paper display panel 120 may include a color image or a gray level image, the image content is determined by an image data S2 inputted to the display driver 110, and may include plain text content or other non-text content. The flexible electronic paper display apparatus 100 of the embodiment of the disclosure may also be a flexible organic light-emitting diode display apparatus or other flexible display apparatuses.

Figure 2:
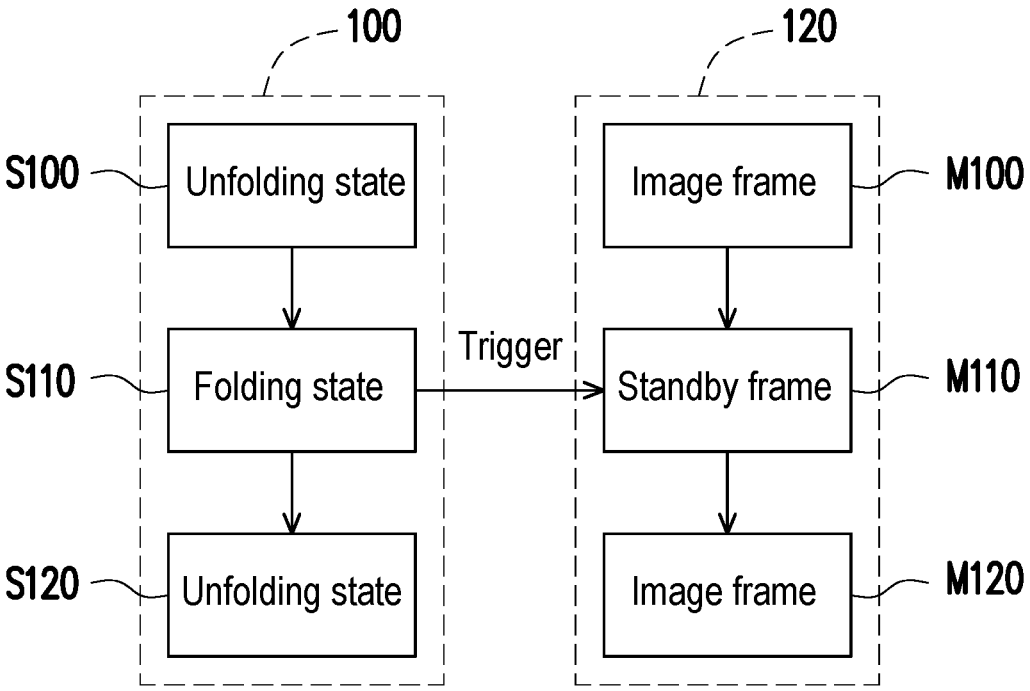
FIG. 2 is a schematic view showing a state change of the flexible electronic paper display apparatus and the corresponding displayed frames according to an embodiment of the disclosure.

FIG. 2 is a schematic view showing a state change of the flexible electronic paper display apparatus and the corresponding displayed frames according to an embodiment of the disclosure. Referring to FIG. 1 and FIG. 2, the state change of the flexible electronic paper display apparatus 100 may include a change from an unfolding state (first state) S100 to a folding state (second state) S110, then a change from the folding state S110 back to an unfolding state S120. Correspondingly, the frames displayed by the flexible electronic paper display panel 120 are respectively an image frame M100, a standby frame M110, and an image frame M120.

The unfolding states S100 and S120 are a state in which a user is using the flexible electronic paper display apparatus for reading or viewing, so the unfolding states S100 and S120 may also be a slightly folding state, i.e., a first state which may allow normal use for reading or viewing. In the unfolding states S100 and S120, the flexible electronic paper display panel 120 may be set to a flat, unfolded, or unrolled state. In the unfolding states S100 and S120, the display driver 110 drives the flexible electronic paper display panel 120 by at least one of a plurality of gray levels to respectively display the image frames M100 and M120. The image content of the image frames M100 and M120 may be the same or different, is determined by the image data S2 inputted to the display driver 110, and may include plain text content or other non-text content. The gray level range for driving the flexible electronic paper display panel 120 may be a gray level range of gray levels 0 to 15, 0 to 127, or 0 to 255. However, the disclosure is not limited to the above gray level ranges.

On the other hand, the folding state S110 is a state in which the user is not using the flexible electronic paper display apparatus 100, e.g., in a storage state, and the flexible electronic paper display apparatus 100 is in a standby state. In the folding state S110, the flexible electronic paper display panel 120 may be set to an uneven, folded, or rolled state. In the folding state S110, the display driver 110 drives the flexible electronic paper display panel 120 by a predetermined gray level to display the standby frame M110. The display driver 110 determines the predetermined gray level according to the gray levels 0 to 15, 0 to 127, or 0 to 255. The standby frame M110 may be a gray frame with the same one gray level. Alternatively, the standby frame M110 may include a dot pattern.

Figure 3:
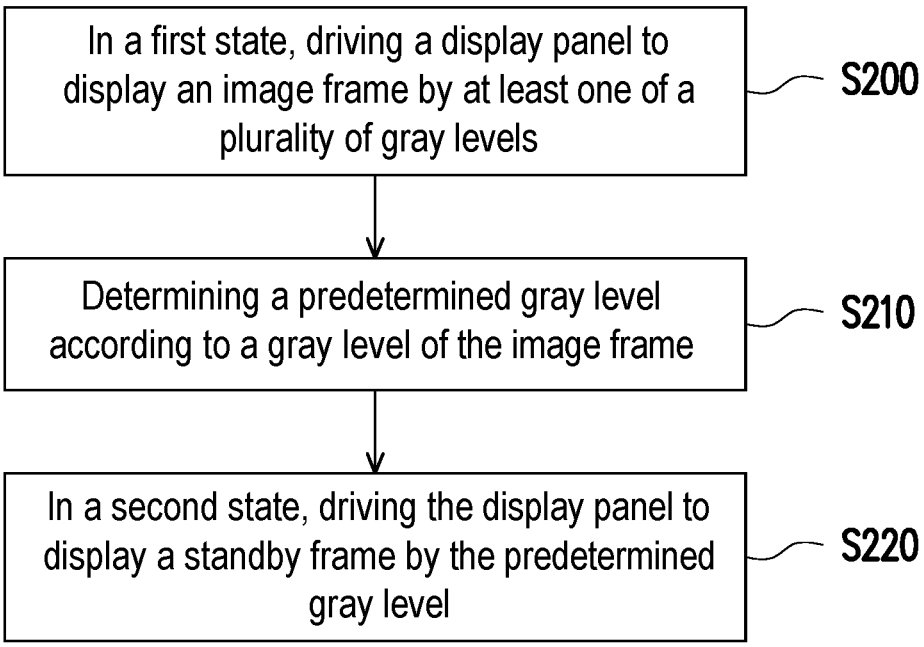
FIG. 3 is a flowchart showing steps of a driving method of a display apparatus according to an embodiment of the disclosure.

FIG. 3 is a flowchart showing steps of a driving method of a display apparatus according to an embodiment of the disclosure. Referring to FIG. 1 and FIG. 3, the driving method of this embodiment is applicable to the display apparatus 100 of FIG. 1, for example. In step S200, in a first state, the display driver 110 drives the display panel 120 by at least one of a plurality of gray levels to display an image frame. In step S210, the display driver 110 determines a predetermined gray level according to the gray level. In step S220, in a second state, the display driver 110 drives the display panel 120 by the determined predetermined gray level to display a standby frame.

In addition, the driving method of the display apparatus of this embodiment may be sufficient taught, suggested, and described by the descriptions of the embodiment in FIG. 1 to FIG. 2.

In the embodiments of FIG. 1 to FIG. 3, the display driver 110 determines the predetermined gray level of the standby frame according to the gray level of the image frame. The following describes the different embodiments of determining the predetermined gray level of the standby frame.

First Embodiment

In the unfolding state, the display driver 110 drives the flexible electronic paper display panel 120 by gray levels 0 to 15, for example, to display the image frame. In this embodiment, in the folding state, the display driver 110 may select a first gray level 7 or a second gray level 8 to drive the flexible electronic paper display panel 120 to display the standby frame. In other words, the predetermined gray level is selected from the first gray level 7 or the second gray level 8, and the gray levels 0 to 15 include the first gray level 7 and the second gray level 8. The arithmetic mean "7.5" of the first gray level 7 and the second gray level 8 is the median of the gray levels 0 to 15.

Figure 4:
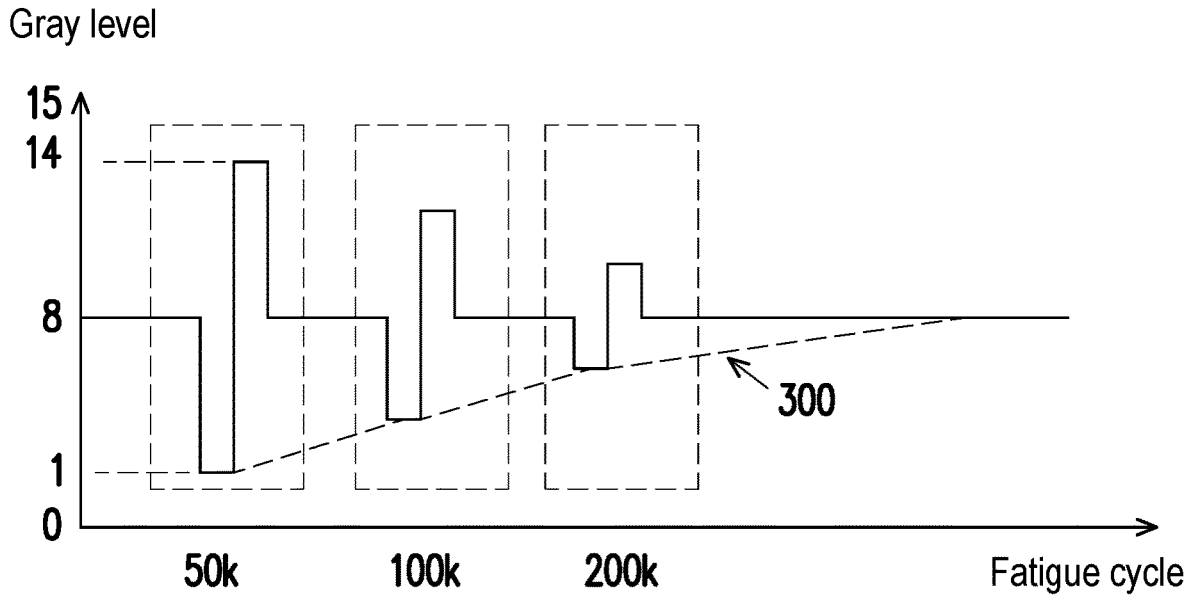
FIG. 4 is a diagram showing the relationship between a fatigue cycle and gray level decay of a flexible electronic paper display apparatus according to an embodiment of the disclosure.

FIG. 4 is a diagram showing the relationship between a fatigue cycle and gray level decay of a flexible electronic paper display apparatus according to an embodiment of the disclosure. Referring to FIG. 4, the vertical axis of FIG. 4 indicates that the gray levels used to drive the flexible electronic paper display panel 120 to display the image frame are 0 to 15, and the predetermined gray level used to drive the flexible electronic paper display panel 120 to display the standby frame is, for example, 8. The horizontal axis of FIG. 4 indicates the times of mechanical fatigue (i.e., fatigue cycle) experienced by the flexible electronic paper display apparatus 100 during repeated folding or rolling, which are respectively fifty thousand times (50k), one hundred thousand times (100k), and two hundred thousand times (200k).

In this embodiment, the 16-gray-level black-and-white flexible electronic paper display apparatus 100 uses a frame of the predetermined gray level 8 as the standby frame in the folding state. Therefore, the standby frame is a gray frame with the same one gray level. In this embodiment, the gray level 0 is defined as a black frame, and the gray level 15 is defined as a white frame. In an embodiment, a frame of the predetermined gray level 7 may also be used as the standby frame in the folding state. When the flexible electronic paper display apparatus 100 is subjected to the mechanical fatigue effect during repeated folding or rolling so that the performance of the flexible electronic paper display panel 120 decays and the driving capacity thus decreases, the performance decay is as shown by a curve 300. Since the standby frame of the flexible electronic paper display apparatus 100 is a frame of the gray level 8, the maximum gray level difference from a black image frame (gray level 0) or a white image frame (gray level 15) is 7 to 8 gray levels. With the maximum gray level difference between the standby frame and the image frame being within 7 to 8 gray levels, it is possible to prevent the human visual perception from perceiving the disuniformity of the image frame in the unfolding state, and thus it is possible to provide a good user experience. In other words, when the display is in a folding or rolling state, it is on standby with a specific frame. After the performance of the electronic paper ink decays due to the mechanical fatigue effect, with the specific standby frame, the difference from the surrounding display elements is small, and it is difficult for the human eye to determine the difference. Therefore, it is possible to prevent the human visual perception from perceiving the disuniformity of the image frame in the unfolding state.

For example, the mechanical strength of the ink in the electronic ink layer exhibits a certain Gaussian distribution during the manufacturing process. Therefore, in a bending region, most of the electronic paper ink which is subjected to the fatigue effect but has driving capacity not yet impaired can be normally driven to the gray level 15 when driving for a white frame. In the bending region, a small part of the electronic paper ink which has decayed due to the fatigue effect can only be driven to the gray level 14 when driving for a white frame. Therefore, compared with the adjacent unimpaired electronic ink, there is a difference of only one gray level. Moreover, since its quantity is much smaller than that of the unimpaired electronic paper ink, it is possible to prevent the human visual perception from perceiving the disuniformity of the frame. The same also applies to the opposite scenario. When the electronic ink in the bending region is driven for a black frame, there is a difference of only one gray level between most of the electronic paper ink which is subjected to the fatigue effect but has driving capacity not yet impaired, and a small part of the adjacent electronic paper ink whose driving capacity has decayed due to the fatigue effect. Therefore, it is possible to prevent the human visual perception from perceiving the disuniformity of the frame. In an embodiment, a 128-gray-level black-and-white flexible electronic paper display apparatus 100 uses, for example, a frame of a predetermined gray level 63 or 64 as the standby frame in the folding state. In another embodiment, a 256-gray-level black-and-white flexible electronic paper display apparatus 100 uses, for example, a frame of a predetermined gray level 127 or 128 as the standby frame in the folding state.

Second Embodiment

In this embodiment, taking the 16-gray-level black-and-white flexible electronic paper display apparatus 100 as an example, when the use context of the flexible electronic paper display apparatus 100 is a dark background, the predetermined gray level of the standby frame of the flexible electronic paper display apparatus 100 in the folding state may be set to one of 0 to 8. For example, in the unfolding state, the display driver 110 drives the flexible electronic paper display panel 120 by the lowest gray level 0 to display the background part of the image frame (i.e., the gray level of the background part of the image frame is 0). In the folding state, the gray level of the standby frame may also be set to 0. Therefore, when the use context of the flexible electronic paper display apparatus 100 is a dark background, the predetermined gray level is greater than or equal to the lowest gray level 0, and the predetermined gray level is less than the second gray level 8.

In another embodiment, the predetermined gray level of the standby frame of the flexible electronic paper display apparatus 100 in the folding state may be set to one of 0 to 7. Therefore, when the use context of the flexible electronic paper display apparatus 100 is a dark background, the predetermined gray level is greater than or equal to the lowest gray level 0, and the predetermined gray level is less than the first gray level 7.

On the other hand, in this embodiment, when the use context of the flexible electronic paper display apparatus 100 is a light-color background, the predetermined gray level of the standby frame of the flexible electronic paper display apparatus 100 in the folding state may be set to one of 7 to 15. For example, in the unfolding state, the display driver 110 drives the flexible electronic paper display panel 120 by the highest gray level 15 to display the background part of the image frame (i.e., the gray level of the background part of the image frame is 15). In the folding state, the gray level of the standby frame may also be set to 15. Therefore, when the use context of the flexible electronic paper display apparatus 100 is a light-color background, the predetermined gray level is less than or equal to the highest gray level 15, and the predetermined gray level is greater than the first gray level 7.

In another embodiment, the predetermined gray level of the standby frame of the flexible electronic paper display apparatus 100 in the folding state may be set to one of 8 to 15. Therefore, when the use context of the flexible electronic paper display apparatus 100 is a light-color background, the predetermined gray level is less than or equal to the highest gray level 0, and the predetermined gray level is greater than the second gray level 8.

Third Embodiment

In this embodiment, the display driver 110 calculates a gray level average of each pixel on the flexible electronic paper display panel 120, and determines the predetermined gray level according to the gray level average of each pixel. In other words, the display driver 110 counts the gray level or color displayed by each pixel during the use process according to the use condition of the flexible electronic paper display apparatus 100, and calculates an average of the gray level displayed by each pixel to set this gray level average as the predetermined gray level of the standby frame.

For example, taking the 16-gray-level black-and-white flexible electronic paper display apparatus 100 as an example, in the application of an e-book reader, in the unfolding state, the peripheral region of the image frame mainly displays a white background, and the middle region mainly displays black texts on a white background. Therefore, in the folding state, the predetermined gray level of the peripheral region of the standby frame may be set to 15, and the predetermined gray level of the middle region may be set to 6 to 9.

Fourth Embodiment

Figure 5:
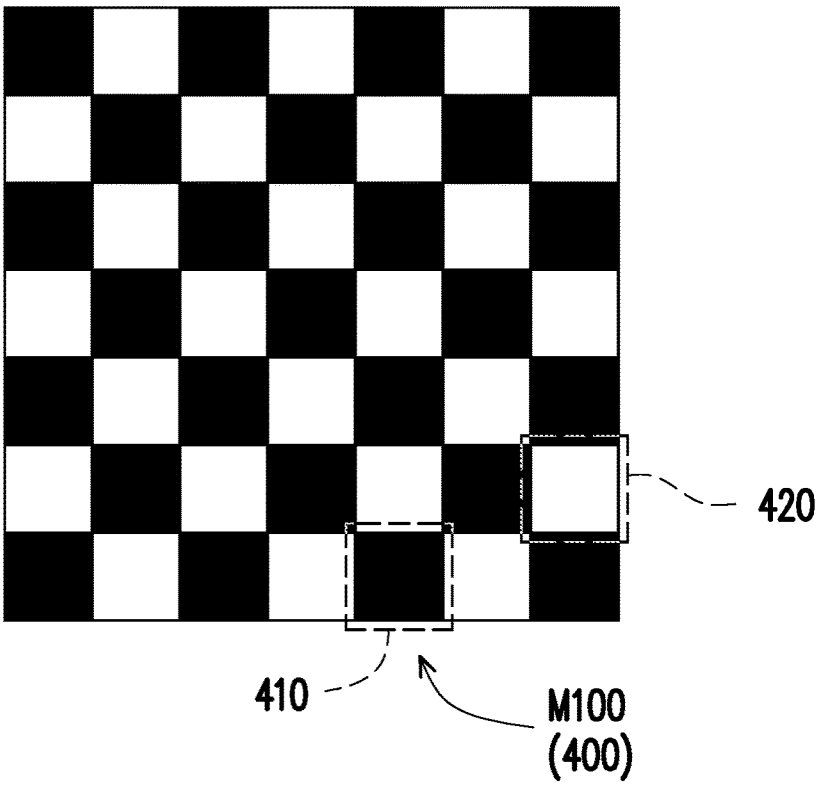
FIG. 5 is a schematic view showing a standby frame including a dot pattern according to an embodiment of the disclosure.

FIG. 5 is a schematic view showing a standby frame including a dot pattern according to an embodiment of the disclosure. Referring to FIG. 5, the standby frame M110 in this embodiment includes a dot pattern 400. The dot pattern 400 includes a plurality of pixel blocks 410 and 420. Each pixel block includes at least one pixel. For example, each pixel block includes 1 to 5 pixels. In this embodiment, the display driver 110 drives a part of the pixel blocks by a predetermined gray level to display the standby frame M110. For example, taking the 16-gray-level black-and-white flexible electronic paper display apparatus 100 as an example, the display driver 110 drives the pixel blocks 410 by a predetermined gray level 0 to display the darker blocks in the standby frame M110. The pixel blocks 410 driven by the predetermined gray level 0 are not adjacent to each other in the horizontal direction and the vertical direction. Similarly, the display driver 110 drives the pixel blocks 420 by a predetermined gray level 15 to display the lighter-color blocks in the standby frame M110. The pixel blocks 420 driven by the predetermined gray level 15 are not adjacent to each other in the horizontal direction and the vertical direction. Therefore, the pixel blocks 410 and 420 are evenly distributed on the standby frame M110 to form the dot pattern 400.

In this embodiment, since the flexible electronic paper display panel 120 is driven by the evenly distributed pixel blocks 410 and 420 as the standby frame M110 in the folding state, even if the performance of the flexible electronic paper display panel 120 decreases due to the mechanical fatigue effect, the user's perception of disuniformity of the image frame in the unfolding state decreases, and thus a good user experience can be provided. For example, in the dot-patterned standby frame, there is respectively half probability for the electronic ink which is potentially impaired due to the fatigue effect to be distributed in the black pixel regions and in the white pixel regions. Therefore, the disuniformity of the image frame perceived by the user in normal use is half of that in the case of using a standby frame of the gray level 15 or the gray level 0.

Fifth Embodiment

Taking a color flexible electronic paper display apparatus as an example, the display driver 110 drives the flexible electronic paper display panel 120 by a light-gray gray level to display the standby frame in the folding state. In the gray level range of 0 to 15, the light-gray gray level is a gray level greater than 8. In the gray level range of 0 to 255, the light-gray gray level is a gray level greater than 128.

When the performance of the flexible electronic paper display panel 120 decreases due to the mechanical fatigue effect, the light-gray failed pixels may be easily rendered by the surrounding normal pixels, so that the user's perception of disuniformity of the image frame in the unfolding state is also reduced. For example, the human perception of color is limited by the effects of chromatic adaptation, luminance, the object area, etc. In terms of chromatic adaptation, white is most likely affected by surrounding colors. For example, when a small white dot is surrounded by red color, the human eye will determine it as lighter red instead of a white dot and multiple red dots, which is namely the rendering effect. In terms of luminance, when the luminance is insufficient, the human eye cannot perceive its existence. Therefore, light gray reduces the luminance and makes it less perceivable when the pixels gradually fail. In terms of the object area, when the object area is extremely small, the human eye cannot perceive the existence of the failed pixels.

Therefore, the display driver 110 may determine the predetermined gray level according to at least one method among the first embodiment to the fifth embodiment, but the disclosure is not limited to the above five methods.

In summary of the above, in the embodiments of the disclosure, the display driver determines the predetermined gray level according to the gray level of the image frame. In the folding state, the display driver drives the flexible electronic paper display panel by the determined predetermined gray level to display the standby frame. Accordingly, it is possible to prevent the user from perceiving the disuniformity of the image frame in the unfolding state.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display apparatus comprising:

a display panel; and a display driver coupled to the display panel and configured to:

in a first state, drive the display panel by at least one of a plurality of gray levels to display an image frame, and in a second state, drive the display panel by a predetermined gray level to display a standby frame, wherein the display driver determines the predetermined gray level according to the gray levels of the image frame, wherein the first state is an unfolding state of the display apparatus and the second state is a folding state of the display apparatus, wherein the standby frame displayed in the folding state prevents a user from perceiving a disuniformity of the image frame displayed in the unfolding state, wherein the gray levels comprise a first gray level and a second gray level, the gray levels further comprise a highest gray level, and in the first state, the display driver drives the display panel by the highest gray level to display a background part of the image frame, wherein the first gray level and the second gray level are less than the highest gray level, and the predetermined gray level is less than or equal to the highest gray level, and the predetermined gray level is greater than the first gray level or the second gray level.

2. The display apparatus according to claim 1, wherein the gray levels comprise a first gray level and a second gray level, and the predetermined gray level is selected from the first gray level or the second gray level.

3. The display apparatus according to claim 1, wherein the gray levels comprise a first gray level and a second gray level, the gray levels further comprise a lowest gray level, and in the first state, the display driver drives the display panel by the lowest gray level to display a background part of the image frame, wherein the first gray level and the second gray level are greater than the lowest gray level, and the predetermined gray level is greater than or equal to the lowest gray level, and the predetermined gray level is less than the first gray level or the second gray level.

4. The display apparatus according to claim 1, wherein the display driver is further configured to calculate a gray level average of each pixel on the display panel, and determine the predetermined gray level according to the gray level average of each pixel.

5. A display apparatus comprising:

a display panel; and a display driver coupled to the display panel and configured to:

in a first state, drive the display panel by at least one of a plurality of gray levels to display an image frame, and in a second state, drive the display panel by a predetermined gray level to display a standby frame, wherein the display driver determines the predetermined gray level according to the gray levels of the image frame, wherein the first state is an unfolding state of the display apparatus and the second state is a folding state of the display apparatus, wherein the standby frame displayed in the folding state prevents a user from perceiving a disuniformity of the image frame displayed in the unfolding state, wherein the standby frame comprises a dot pattern, the dot pattern comprises a plurality of pixel blocks, each of the pixel blocks comprises at least one pixel, and the display driver drives a part of the pixel blocks by the predetermined gray level to display the standby frame, wherein the pixel blocks driven by the predetermined gray level are not adjacent to each other in a horizontal direction and a vertical direction.

6. A driving method of a display apparatus comprising a display panel, the driving method comprising:

in a first state, driving the display panel by at least one of a plurality of gray levels to display an image frame;

determining a predetermined gray level according to the gray levels of the image frame; and in a second state, driving the display panel by the predetermined gray level to display a standby frame, wherein the first state is an unfolding state of the display apparatus and the second state is a folding state of the display apparatus, wherein the standby frame displayed in the folding state prevents a user from perceiving a disuniformity of the image frame displayed in the unfolding state, wherein the standby frame comprises a dot pattern, the dot pattern comprises a plurality of pixel blocks, each of the pixel blocks comprises at least one pixel, and the step of driving the display panel by the predetermined gray level to display the standby frame in the second state comprises:

driving a part of the pixel blocks by the predetermined gray level to display the standby frame, wherein the pixel blocks driven by the predetermined gray level are not adjacent to each other in a horizontal direction and a vertical direction.

7. The driving method of the display apparatus according to claim 6, wherein the gray levels comprise a first gray level and a second gray level, and the predetermined gray level is selected from the first gray level or the second gray level.

8. The driving method of the display apparatus according to claim 6, further comprising:

in the first state, driving the display panel by a lowest gray level to display a background part of the image frame, wherein the gray levels comprise a first gray level, a second gray level, and the lowest gray level, the first gray level and the second gray level are greater than the lowest gray level, wherein the predetermined gray level is greater than or equal to the lowest gray level, and the predetermined gray level is less than the first gray level or the second gray level.

9. The driving method of the display apparatus according to claim 7, further comprising:

in the first state, driving the display panel by a highest gray level to display a background part of the image frame, wherein the gray levels comprise a first gray level, a second gray level, and the highest gray level, the first gray level and the second gray level are less than the highest gray level, wherein the predetermined gray level is less than or equal to the highest gray level, and the predetermined gray level is greater than the first gray level or the second gray level.

* * * * *